US009881493B2

(12) United States Patent
Kim et al.

(10) Patent No.: US 9,881,493 B2
(45) Date of Patent: *Jan. 30, 2018

(54) COMMUNICATION MODULE AND LIGHTING APPARATUS HAVING THE SAME

(71) Applicant: LG INNOTEK CO., LTD., Seoul (KR)

(72) Inventors: Dae Hun Kim, Seoul (KR); Yull Oh Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/085,019

(22) Filed: Mar. 30, 2016

(65) Prior Publication Data

US 2016/0210847 A1 Jul. 21, 2016

Related U.S. Application Data

(63) Continuation of application No. 13/712,272, filed on Dec. 12, 2012, now Pat. No. 9,324,231.

(30) Foreign Application Priority Data

May 10, 2012 (KR) ..... 10-2012-0049417
Nov. 2, 2012 (KR) ..... 10-2012-0123562
Nov. 2, 2012 (KR) ..... 10-2012-0123563

(51) Int. Cl.
*H05B 39/00* (2006.01)
*H05B 41/00* (2006.01)
(Continued)

(52) U.S. Cl.
CPC ..... *G08C 17/02* (2013.01); *G08B 5/36* (2013.01); *G08B 21/187* (2013.01); *H05B 37/02* (2013.01); *H05B 37/0272* (2013.01)

(58) Field of Classification Search
CPC ..... F21Y 2101/02; F21K 9/00; F21V 29/004; F21V 15/01; F21W 2131/103
(Continued)

(56) References Cited

U.S. PATENT DOCUMENTS 6,137,095 A 10/2000 Kashimoto et al.
7,440,287 B1 * 10/2008 Ni ..... H01R 27/00 174/50.51
(Continued)

FOREIGN PATENT DOCUMENTS

CN 101737654 A 6/2010
EP 0 933 596 A1 8/1999
(Continued)

OTHER PUBLICATIONS

Korean Office Action dated Aug. 16, 2013 issued in Application No. 10-2012-0049417.
(Continued)

*Primary Examiner* — Quan Tra
(74) *Attorney, Agent, or Firm* — Ked & Associates, LLP

(57) ABSTRACT

Disclosed are a communication module and a lighting apparatus having the same. The communication module includes a housing provided therein with a space, and a module substrate provided in the space of the housing and provided therein with a wireless communication chip, a reset device to reset the wireless communication chip, and a display part to display the state of the wireless communication chip through the opening. The communication module is detachably coupled with an object to transmit a control signal, which is received through a wireless network, to the object. The communication module is stored when the lighting part of the lighting apparatus is replaced with new one, so that the cost is reduced. The light is discharged through the opening to display the erroneous operation of
(Continued)

the inner part, such that the communication module is forcibly reset.

17 Claims, 12 Drawing Sheets

(51) Int. Cl.
*G08C 17/02* (2006.01)
*H05B 37/02* (2006.01)
*G08B 5/36* (2006.01)
*G08B 21/18* (2006.01)

(58) Field of Classification Search
USPC ..... 315/313; 362/249.02
See application file for complete search history.

(56) References Cited

U.S. PATENT DOCUMENTS

| | | | | |
|---|---|---|---|---|
| 8,347,017 | B2 * | 1/2013 | Tseng | H01R 27/00 710/301 |
| 8,922,124 | B2 * | 12/2014 | Reed | H05B 37/02 315/152 |
| 2003/0090889 | A1 | 5/2003 | Wacyk et al. | |
| 2005/0021895 | A1 * | 1/2005 | Son | G06K 19/077 710/301 |
| 2005/0224589 | A1 * | 10/2005 | Park | G06K 19/07732 235/492 |
| 2005/0270756 | A1 | 12/2005 | Kochis et al. | |
| 2006/0208949 | A1 | 9/2006 | Hirabayashi | |
| 2007/0086199 | A1 * | 4/2007 | Demarest | A01M 1/2083 362/441 |
| 2007/0281500 | A1 * | 12/2007 | Wang | H01R 12/721 439/62 |
| 2008/0143551 | A1 | 6/2008 | Otsuka et al. | |
| 2009/0017645 | A1 * | 1/2009 | Suzuki | H01R 12/88 439/62 |
| 2009/0258514 | A1 | 10/2009 | He et al. | |
| 2010/0044444 | A1 * | 2/2010 | Jain | G06K 7/10237 235/492 |
| 2010/0117558 | A1 * | 5/2010 | Lee | F21K 9/00 315/294 |
| 2010/0118148 | A1 * | 5/2010 | Lee | F21V 3/00 348/164 |
| 2010/0176730 | A1 | 7/2010 | Lee et al. | |
| 2010/0182293 | A1 | 7/2010 | Minamino et al. | |
| 2011/0102271 | A1 * | 5/2011 | Hung | G06F 1/1698 343/700 MS |
| 2011/0310748 | A1 | 12/2011 | Mizugaki et al. | |
| 2012/0045930 | A1 | 2/2012 | Ueda et al. | |
| 2012/0181935 | A1 | 7/2012 | Velazquez | |
| 2013/0115821 | A1 * | 5/2013 | Golko | H01R 13/516 439/638 |

FOREIGN PATENT DOCUMENTS

| | | | |
|---|---|---|---|
| JP | 05-114773 | A | 5/1993 |
| JP | 06-223977 | A | 8/1994 |
| JP | 2004-055473 | | 2/2004 |
| JP | 2005-115690 | | 4/2005 |
| JP | 2005-510026 | A | 4/2005 |
| JP | 2005-184565 | | 7/2005 |
| JP | 2005-214884 | A | 8/2005 |
| JP | 2006-238088 | A | 9/2006 |
| JP | 2008-084613 | A | 4/2008 |
| JP | 2008-153840 | | 7/2008 |
| JP | 3150303 | | 5/2009 |
| JP | 2009-147962 | A | 7/2009 |
| JP | 2011-003320 | A | 1/2011 |
| JP | 2011-193244 | | 9/2011 |
| JP | 2011-238564 | | 11/2011 |
| JP | 2012-004891 | | 1/2012 |
| JP | 2012-043653 | A | 3/2012 |
| KR | 10-2009-0127571 | A | 12/2009 |
| WO | WO 2009/004894 | A1 | 1/2009 |
| WO | WO 2009/103587 | A1 | 8/2009 |
| WO | WO 2011/029066 | A1 | 3/2011 |

OTHER PUBLICATIONS

European Search Report dated Sep. 10, 2013 issued in Application No. 13 16 7303.

Japanese Office Action dated Feb. 12, 2014 issued in Application No. 2012-286917.

Korean Office Action dated Feb. 25, 2014 issued in Application No. 10-2012-0049417.

Chinese Office Action dated Aug. 5, 2015 issued in Application. 201310028317.1 (with English Translation).

United States Office Action dated Mar. 4, 2015 issued in co-pending U.S. Appl. No. 13/712,272.

United States Office Action dated May 27, 2015 issued in co-pending U.S. Appl. No. 13/712,272.

United States Office Action dated Sep. 3, 2015 issued in co-pending U.S. Appl. No. 13/712,272.

Japanese Office Action dated Jan. 10, 2017 issued in Application No. 2014-098754.

Japanese Office Action dated Feb. 21, 2017 issued in Application No. 2013-099472.

* cited by examiner

COMMUNICATION MODULE AND LIGHTING APPARATUS HAVING THE SAME

CROSS-REFERENCE TO RELATED APPLICATION(S)

The present application is a Continuation of co-pending U.S. patent application Ser. No. 13/712,272 filed on Dec. 12, 2012, which claims priority under 35 U.S.C. § 119(a) to Korean Application Nos. 10-2012-0049417 filed on May 10, 2012, 10-2012-0123562 filed on Nov. 2, 2012 and 10-2012-0123563 filed on Nov. 2, 2012, whose entire disclosures are hereby incorporated by reference.

BACKGROUND

The disclosure relates to a communication module and a lighting apparatus including the same.

In general, a switch connected to a lighting apparatus through a cable is manually manipulated in order to turn on or turn off the lighting apparatus. In this case, the patient, the old, or the infirm that cannot freely move, or children that cannot reach the switch feel inconvenience when turning on or turning off the lighting apparatus.

Recently, in order to remove the inconvenience, a lighting apparatus, which is turned on or turn off, and can adjust lighting intensity by using a remote controller, has been released.

As the market of the lighting apparatus has been diversified, the requirement for the selective control of the characteristic (color temperature, dimming value, or brightness) of the lighting apparatus, or the selection of a communication scheme based on the speed/distance/power consumption among various communication schemes such as ZigBee, WiFi, or Bluetooth is increased.

In addition, since the communication module that receives/processes/transmits the user command is integrally provided with the lighting apparatus, the failure of the power supply part (PSU) provided in the lighting apparatus and/or the failure of an LED, a general lighting unit, or a control part provided in the lighting apparatus may occur. In this case, the lighting apparatus including the communication module must be replaced with new one.

SUMMARY

The embodiment provides a communication module detachably installed in a lighting apparatus.

According to the embodiment, there is provided a communication module including a housing provided therein with a space, and a module substrate in the space of the housing and having a wireless communication chip mounted thereon. The communication module is detachably coupled with an object to transmit a control signal, which is received through a wireless network, to the object.

Meanwhile, according to the embodiment, there is provided a lighting apparatus including a lighting module having at least one light source and a communication module detachably coupled with the lighting module to transmit a control signal received through a wireless network to the lighting module.

According to the embodiment, the wireless communication module is detachably provided in the lighting apparatus, the communication module is detached from the lighting apparatus. Therefore, the communication module can be stored when the lighting part of the lighting apparatus is replaced with new one. Accordingly, the cost can be reduced.

According to the embodiment, when the communication module controls the characteristic (color temperature, dimming value, or brightness) of the lighting apparatus, the communication module can effectively control the characteristic of the lighting apparatus by selectively using a PWM control scheme or a UART control scheme according to the characteristic to be controlled.

According to the embodiment, various wireless communication schemes (ZigBee, WiFi, and Bluetooth) are selectively realized in the wireless communication part in the communication module, so that the optimal wireless communication scheme can selected by taking the speed/distance/power consumption into consideration, thereby effectively transmitting/receiving data and performing a control operation.

A plurality of pins of the interface part constituting the communication module can be standardized in the arrangement sequence and the use of the pins.

DETAILED DESCRIPTION OF THE EMBODIMENTS

Figure 1:
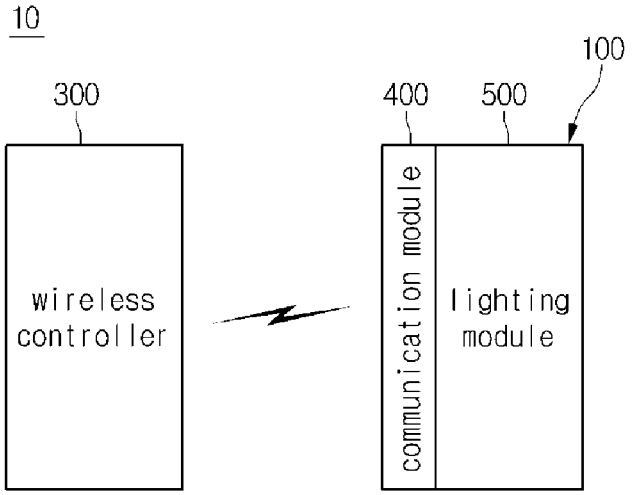
FIG. 1 is a block diagram showing a lighting system according to the embodiment.

Hereinafter, embodiments will be described in detail with reference to accompanying drawings so that those skilled in the art can easily work with the embodiments. However, the embodiments may have various modifications. The thickness and size of each layer shown in the drawings may be exaggerated, omitted or schematically drawn for the purpose of convenience or clarity. In addition, the size of elements does not utterly reflect an actual size. The same reference numbers will be assigned the same elements throughout the drawings.

In the following description, when a predetermined part "includes" a predetermined component, the predetermined part does not exclude other components, but may further include other components if there is a specific opposite description.

The thickness of each layer shown in the drawings may be enlarged for the purpose of convenience or clarity. In addition, the size of elements does not utterly reflect an actual size. The same reference numbers will be assigned the same elements throughout the drawings. In the description of the embodiments, it will be understood that, when a layer, a film, a region or a plate is referred to as being "on" or "under" another layer, another film, another region, or another plate, it can be "directly" or "indirectly" on the other layer, film, region, plate, or one or more intervening layers may also be present. Such a position of the layer has been described with reference to the drawings.

The disclosure provides a lighting system including a communication module detachably installed in a lighting module.

Hereinafter, a lighting system will be described with reference to FIGS. 1 to 5.

Figure 2:
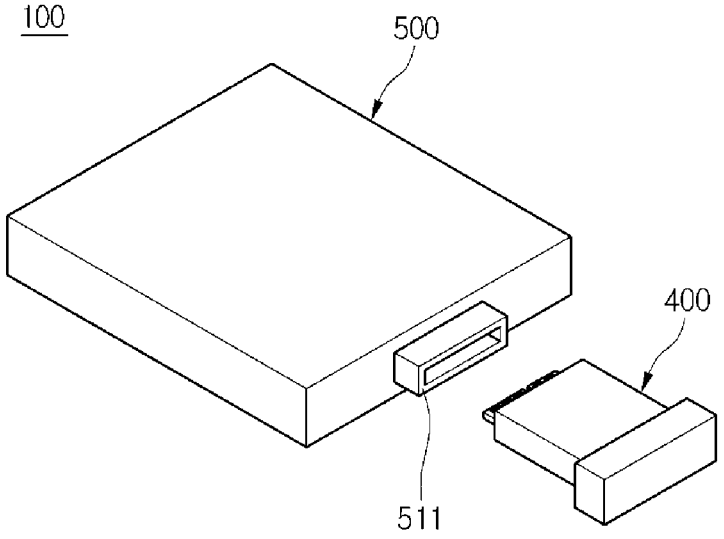
FIG. 2 is a perspective view showing a lighting apparatus of FIG. 1.
Figure 3:
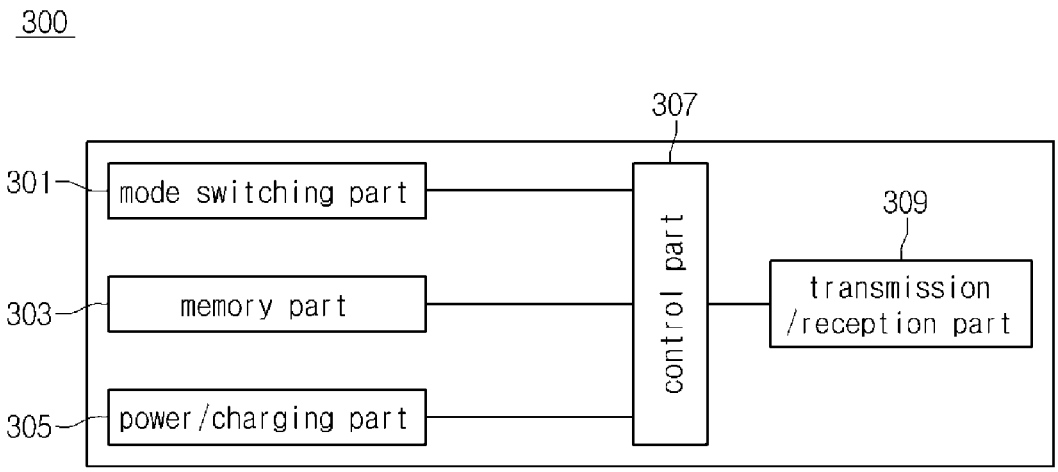
FIG. 3 is a block diagram showing a wireless controller of FIG. 1.
Figure 4:
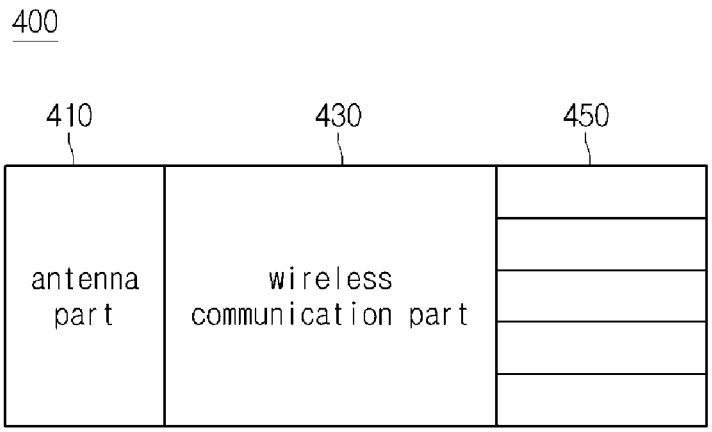
FIG. 4 is a block diagram showing a communication module of FIG. 1.
Figure 5:
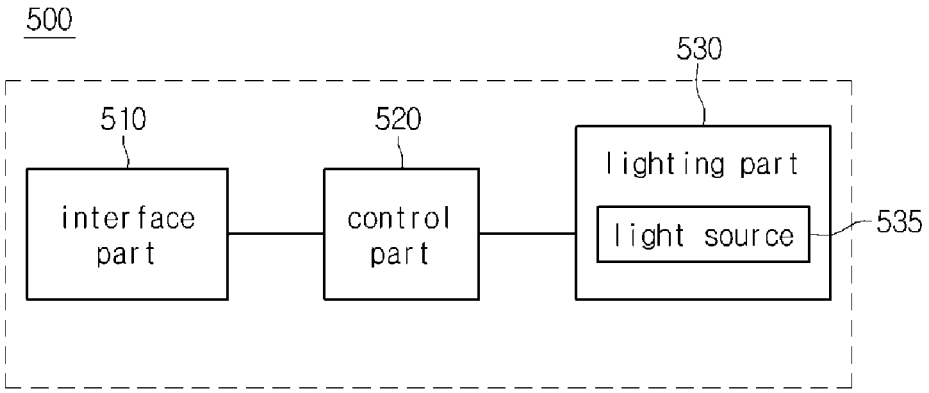
FIG. 5 is a block diagram showing a lighting module of FIG. 1.

FIG. 1 is a block diagram showing a lighting system according to the embodiment, FIG. 2 is a perspective view showing a lighting apparatus of FIG. 1, FIG. 3 is a block diagram showing a wireless controller of FIG. 1, FIG. 4 is a block diagram showing a communication module of FIG. 1, and FIG. 5 is a block diagram showing a lighting module of FIG. 1.

Referring to FIG. 1, the lighting system according to the embodiment includes a wireless controller 300 and a lighting apparatus 100.

The wireless controller 300 is an input unit to input a user command, and transmits a control signal according to the user command to a communication module 400 through a wireless network.

The wireless controller 300 may include a remote controller or a smart phone.

The wireless network between the wireless controller 300 and the communication module 400 may be determined depending on wireless environments In order to wirelessly control the lighting, a ZigBee, Bluetooth, or Z-wave network may be applied.

The wireless controller 300 may have the structure shown in FIG. 3.

Referring to FIG. 3, the wireless controller 300 includes a mode switching part 301, a memory part 303, a power/charging part 305, a control part 307, and a transmission/reception part 309.

The mode switching part 301 performs the switching of an operating mode of the wireless controller 300. For example, the mode switching part 301 may perform the switching to the control of the lighting apparatus 100 while performing the typical function of the remote controller.

The memory part 303 may store operation and communication control programs/protocols.

The power/charging part 305 charges power or supplies the power so that the wireless controller 300 operates.

The transmission/reception part 309 transmits the user command, which is provided from the controller 307, to the communication module 400 of the lighting apparatus 100 through a preset wireless network.

The controller 307 controls the operations of the mode switching part 301, the power/charging part 305, and the transmission/reception part 309 by using the data stored in the memory part 303.

The lighting apparatus 100 has the structure shown in FIG. 2.

The lighting apparatus 100 includes a lighting module 500 including a lighting part and the communication module 400 to transmit a control signal through the communication with the wireless controller 300.

The communication module 400 constituting the lighting apparatus 100 has a detachable-type structure in which the communication module 400 is fixedly inserted into a connector 511 of the lighting module 500 to transmit a control signal as shown in FIG. 2.

The lighting apparatus 100 includes the connector 511 into which a plurality of pins of an interface part 450 of the communication module 400 are inserted.

As shown in FIG. 2, the connector 511 may protrude, and may be connected with a control part 520 including a power supply part of the lighting module 500.

The communication module 400 of the lighting apparatus 100 is detachably installed in the lighting module 500, so that the communication module 400 may be reused when the power supply part of a lighting part 530 or the control part 520 constituting the lighting module 500 is replaced with new one.

The communication module 400 has the structure shown in FIG. 4.

The communication module 400 includes one housing 411 or 431, the housing 411 or 431 is provided therein with an antenna part 410, a wireless communication part 430, and an interface part 450 while forming one unit.

The antenna part 410 receives the control signal transmitted from the wireless controller 300 through the wireless network.

The wireless communication part 430 receives the control signal from the antenna part 410, and generates a plurality of output signals to be transmitted to the lighting module 500 according to the control signal.

The wireless communication part 430 includes a communication integrated circuit 435 to analyze the control signal of the antenna part 410 according to the types of the wireless network.

In other words, the communication module 400 selects the communication integrated circuit 435 according to the determined wireless network environment to install the communication integrated circuit 435 therein.

The communication integrated circuit 435 may support at least one of ZigBee, Z-wave, WiFi, and Bluetooth communication schemes.

The interface part 450 includes a plurality of pins 452*a*, 452*b*, 454*a*, 454*b*, and 454*c* corresponding to a plurality of output signals output from the wireless communication part 430.

As shown in FIG. 4, five pins 452*a*, 452*b*, 454*a*, 454*b*, and 454*c* may be provided, but the embodiment is not limited thereto.

The lighting module 500 includes an interface part 510, a control part 520, and a lighting part 530.

The interface part 510 may include the connector 511 connected to the interface part 450 of the communication module 400 to receive the output signals from the communication module 400.

The controller 520 includes a power supply unit, and receives the output signals from the interface part 450 to supply a lighting signal to the lighting part 530.

The lighting part 530 includes a light source 535, and the light source 535 may include at least one light emitting diode LED.

The interface parts 450 and 510 of the communication module 400 and the lighting module 500 may set the output signals of the pins 452*a*, 452*b*, 454*a*, 454*b*, and 454*c* according to lighting control schemes.

The configurations of the pins 452*a*, 452*b*, 454*a*, 454*b*, and 454*c* according to the lighting control scheme will be described later.

Hereinafter, the structure of a detachable-type communication module 400 fixedly inserted into the lighting module 500 will be described with reference to FIGS. 6 to 11.

Figure 6:
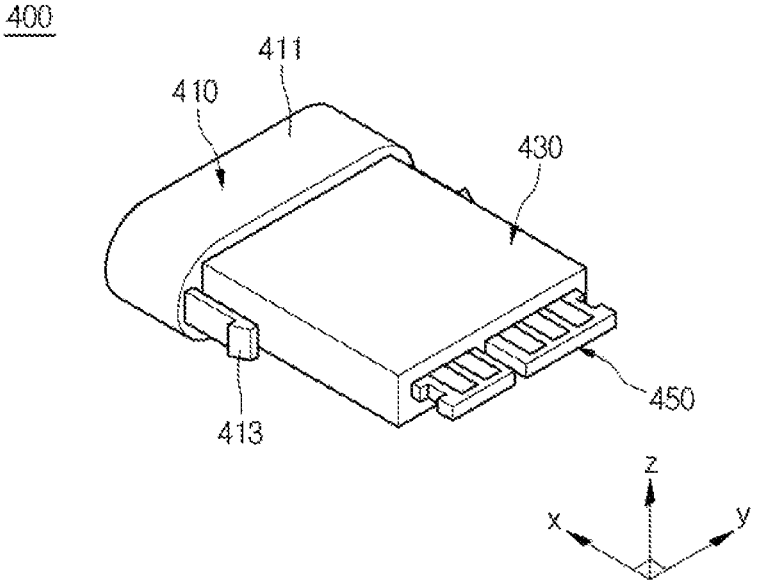
FIG. 6 is a perspective view showing a communication module of FIG. 1.
Figure 7:
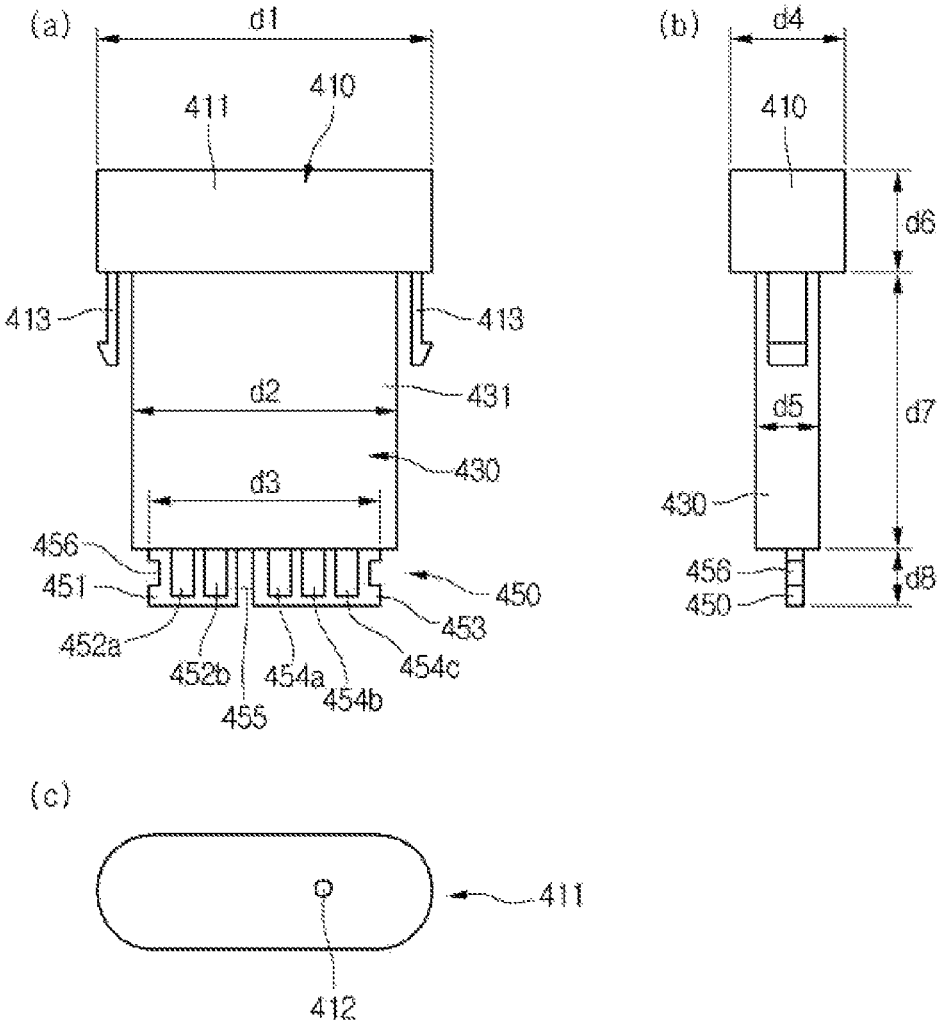
FIGS. 7*a* to 7*c* are a top view of the communication module of FIG. 6, a side view shown in a y axis, and a side view shown in an x axis.
Figure 8:
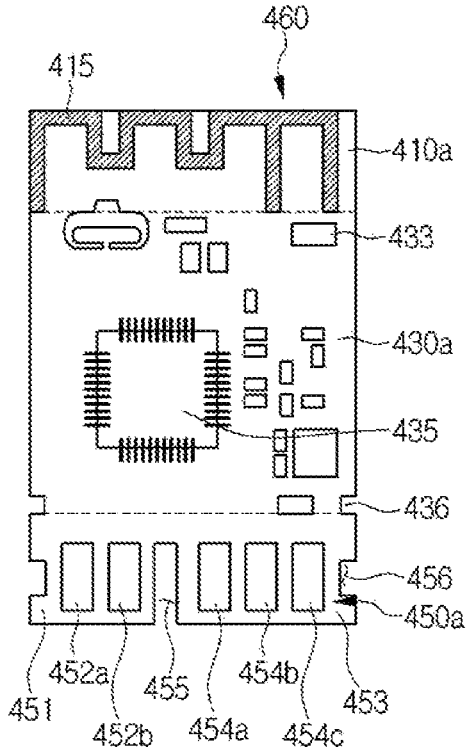
FIG. 8 is a top view showing a printed circuit board provided in the communication module of FIG. 6.
Figure 9:
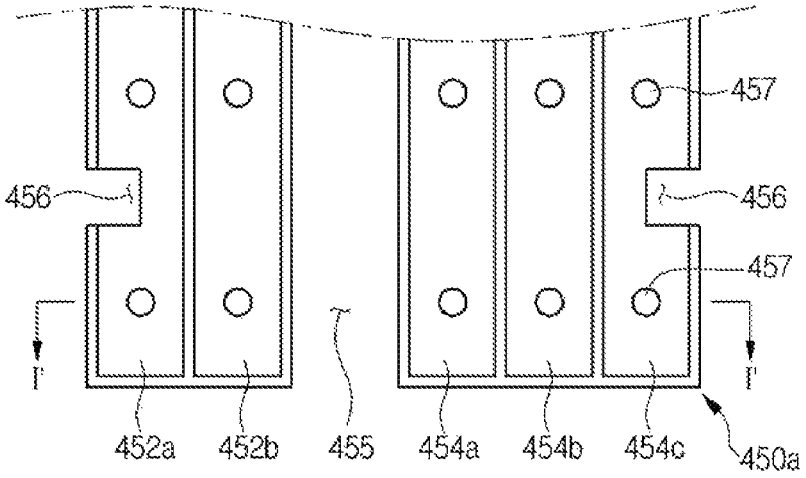
FIG. 9 is an enlarged view showing an interface module of the printed circuit board of FIG. 8.
Figure 10:
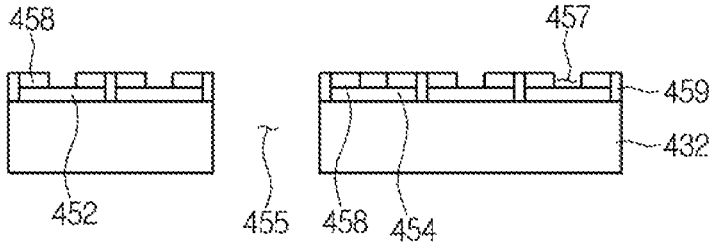
FIG. 10 is a sectional view taken along line I-I' of the interface module of FIG. 9.
Figure 11:
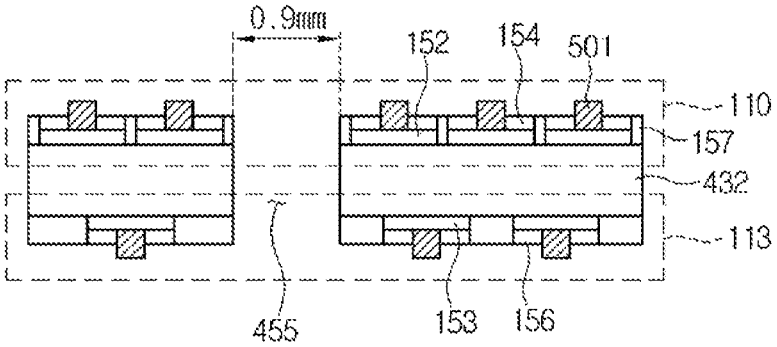
FIG. 11 is a sectional view taken along line I-I' of the interface module of FIG. 9 according to another embodiment.

FIG. 6 is a perspective view showing the communication module 400 of FIG. 1, FIGS. 7A to 7C are a top view showing the communication module 400 of FIG. 6 and side views of the communication module 400 shown in x and y axes, FIG. 8 is a top view showing a printed circuit board inside the communication module 400 of FIG. 6, FIG. 9 is an enlarged view showing the interface module of the printed circuit board of FIG. 8, FIG. 10 is a sectional view taken along line I-I' of the interface part of FIG. 9, and FIG. 11 is a sectional view taken along line I-I' of the interface part of FIG. 9 according to another embodiment.

Referring to FIGS. 6 to 10, the communication module 400 according to the embodiment includes a printed circuit board into which the antenna part 410, the wireless communication part 430, and the interface part 450 are integrated, and housings 411 and 431 to receive a portion of the printed circuit board.

As shown in FIG. 6, in the housings 411 and 431, a region corresponding to the interface part 450 protrudes outward to receive the printed circuit board.

The housings 411 and 431 include a first receiving part 411 to receive the antenna part 410 and a second receiving part 431 protruding in the first direction (x axis) from the first receiving part 411 and receiving the wireless communication part 430.

The first and second receiving parts 411 and 431 may be provided in one body. The first and second receiving parts 411 and 431 may be an assembly in which the upper body and the lower body are coupled with each other in a second direction (z axis) perpendicular to the first direction (x axis).

The housings 411 and 431 may include an insulating material. Preferably, the housings 411 and 431 may include plastic, such as polyimide, that is rigid.

The first receiving part 411 is provided therein with a space to receive the antenna part 410 of the printed circuit board, and has a rectangular shape having a long length in the third direction (y axis).

The first receiving part 411 may have a first width d1 of 20 mm to 25 mm, preferably, the first width d1 of 22 mm in the third direction (y axis), and may have a width d6 of 6 mm to 7 mm, preferably, the width d6 of 6.4 mm to 6.5 mm in the first direction (x axis). In addition, the first receiving part 411 has the height d4 of 7 mm to 8 mm, preferably, the length d4 of 7.7 mm in the second direction (z axis).

The side of the first receiving part 411 may be chamfered in such a manner that the side has a predetermined curvature.

The printed circuit board inserted into the space of the first receiving part 411 includes an antenna region corresponding to the antenna part 410.

An antenna region 410*a* is formed at one end of the printed circuit board as shown in FIG. 8, and includes an antenna pattern 415 formed on the support substrate 432 through the patterning process.

The antenna pattern 415 may have a planar inverted F antenna (PIFA), but the embodiment is not limited thereto.

In other words, the antenna pattern 415 may be realized in the shape of a monopole antenna, or the shape of a dipole antenna.

The antenna region 410*a* may include the support substrate 432 serving as a dielectric body of the antenna, the antenna pattern 415 formed on the support substrate 432, a ground layer (not shown) under the substrate 432, and a matching pattern (not shown) formed inside or outside the dielectric body 432.

The antenna part 410 is provided to transmit/receive a signal having a preset frequency band. In other words, the antenna pattern 415 makes resonance at the frequency band to allow a signal to pass therethrough.

The antenna pattern 415 is provided adjacent to the ground layer, and has one end serving as a feeding point. In this case, the feeding point may extend to the bottom surface of the support substrate 432 through the support substrate 432 serving as the dielectric body. In addition, the antenna pattern 415 may include at least one horizontal component circuit and at least one vertical component circuit distinguished from each other by at least one bending part.

For example, an antenna device 120 may be prepared in the form of a transmission circuit corresponding to at least one of a meander type, a spiral type, a step type, and a loop type.

A ground layer is provided to ground an antenna pattern 415.

The internal or external matching pattern is provided in order to match the impedance of the antenna pattern 415 with reference impedance.

As described, the antenna part 410 is provided in the form of a plate, so that the antenna part 410 may be integrated in the small-size communication module 400.

The antenna pattern 415 may include a conductive material or a material containing metal such as copper (Cu), aluminum (Al), nickel (Ni), or molybdenum (Mo).

Meanwhile, the second receiving part 431 protruding in the first direction (x axis) from the first receiving part 411 may have a width d2 of 17 mm to 18 mm, preferably, the width d2 of 17.4 mm to 17.5 mm in the third direction (y axis). In addition, the second receiving part 431 may have a width d7 of 18 mm to 19 mm, preferably, the width d7 of 18 mm to 18.2 mm in the first direction (x axis). In addition, the height d5 of the second receiving part 431 in the second direction (z axis) may be in the range of 4.5 mm to 5.2 mm, preferably, may be 5 mm.

Since the second receiving part 431 has the width d2 narrower than the width of the first receiving part 411 in the third direction (y axis) as described above, a predetermined dummy space is formed at the lateral side of the first receiving part 411. In addition, since the second receiving part 431 has a height d5 lower than that of the first receiving part 411, the second receiving part 431 may be formed with a step difference from the first receiving part 411.

The second receiving part 431 has the shape of a cylinder having a space to receive the wireless communication part 430 of the printed circuit board therein. The second receiving part 431 may have a rectangular parallelepiped shape as shown in FIG. 6.

A fixing part 413 is formed in the space formed at the lateral side of the first receiving part 411.

As shown in FIG. 6, the fixing part 413 is formed at the dummy space resulting from the difference in an area between the first and second receiving parts 411 and 431, and protrudes in the first direction (x axis) from the lateral side of the first receiving part 411.

Since the fixing part 413 is integrally formed with a body of the housing 411 or 431 and provided at one end thereof with a triangular protrusion, the fixing part 413 is locked with the lighting module 500 when being inserted into the lighting module 500, so that the fixing strength may be improved.

Fixing parts 413 may be formed at both lateral sides of the second receiving part 431, and the triangular protrusions of the fixing parts 413 may be provided in opposition to each other so that the triangular protrusions are directed outward.

Meanwhile, as shown in FIG. 8, a plurality of devices are mounted in a module region 430*a* of the printed circuit board corresponding to the wireless communication part 430 inserted into the second receiving part 431.

The module region 430*a* has a wireless integrated circuit 435 installed therein in order to make communication with the wireless control module 300, and the wireless integrated circuit 435 may selectively employ one of ZigBee, WiFi, Z-wave, and Bluetooth wireless integrated circuits according to the wireless environment. In this case, the passive devices and the circuit configurations of a peripheral part of the wireless integrated circuit 435 may be varied according to the types of the wireless integrated circuit 435.

A connection pattern 433 may be formed at the boundary region between the module region 430*a* and the antenna region 410*a* for the purpose of connection with an external antenna.

A recess part 436 is formed at the boundary region between the module region 430*a* and a terminal region 450*a* to fix the housing 411 or 431 to the printed circuit board. The recess part 436 is coupled with the protrusion formed on the inner surface of the housing 411 or 431.

The terminal region 450*a* of the printed circuit board corresponding to the interface part 450 protruding from the end portion of the second receiving part 431 of the housings 411 and 431 includes the pins 452*a*, 452*b*, 454*a*, 454*b*, and 454*c* as shown in FIG. 6.

The terminal region 450*a* may have the length d8 of 3.5 mm to 4.0 mm in the first direction (x axis) from the end portion of the housing 411 or 431, and may have the width d3 of 15 mm in the third direction (y axis).

The terminal region 450*a* includes the pins 452*a*, 452*b*, 454*a*, 454*b*, and 454*c* on the support substrate 431, and the pins 452*a*, 452*b*, 454*a*, 454*b*, and 454*c* may include five pins 452*a*, 452*b*, 454*a*, 454*b*, and 454*c*, but the embodiment is not limited thereto.

If the five pins 452*a*, 452*b*, 454*a*, 454*b*, and 454*c* are provided as described above, the five pins 452*a*, 452*b*, 454*a*, 454*b*, and 454*c* are grouped into several groups, and the terminal region 450*a* includes a recess part 455 obtained by removing the support substrate 432 between the grouped pins.

The group of the pins 452*a* and 452*b* provided at the left side of the recess part 455 is defined as a first pin part 451, and the group of the pins 454*a*, 454*b*, and 454*c* provided at the right side of the recess part 455 is defined as a second pin part 453.

The number of pins of the first pin part 451 is different from the number of pins of the second pin part 453.

When the terminal region 450*a* includes the five pins 452*a*, 452*b*, 454*a*, 454*b*, and 454*c*, the first pin part 451 may include two pins 452*a* and 452*b*, and the second pin part 453 may include three pins 454*a*, 454*b*, and 454*c*.

The pins 452*a*, 452*b*, 454*a*, 454*b*, and 454*c* are grouped into several groups in such a manner that the groups have the different numbers of pins, so the front surface of the communication module 400 is distinguished from the rear surface of the communication module 400.

In addition, the recess part 455 is formed between the first and second pin parts 451 and 453, thereby preventing the pins 452*a*, 452*b*, 454*a*, 454*b*, and 454*c* of the first and second pin parts 451 and 453 from interfering with each other.

The width of the recess part 455 may be equal to or greater than 0.9 mm, and the pins 452*a*, 452*b*, 454*a*, 454*b*, and 454*c* may be spaced apart from each other by the interval of 0.8 mm or less, but the embodiment is not limited thereto.

A protrusion (not shown) protruding from the support substrate 432 may be additionally provided in the boundary region between the first and second pin parts 451 and 453.

Meanwhile, the terminal region 450*a* includes locking grooves 456 recessed in the concave shape from both lateral sides.

Although each locking groove 456 may be formed in a dummy region of the edge region without the pins 452*a*, 452*b*, 454*a*, 454*b*, and 454*c* as shown in FIG. 8, the locking groove 456 may be formed by removing portions of the pins 452*a*, 452*b*, 454*a*, 454*b*, and 454*c* as shown in FIG. 9.

The locking groove 456 is coupled with the internal protrusion (not shown) of the connector 511 when the terminal region 450*a* is inserted into the connector 511 of the lighting module 500, so that the coupling strength can be improved.

As shown in FIG. 9, the terminal region 450*a* may include at least one concave part 457 formed at the edge region positioned in the first direction (x axis) of each pin 452*a*, 452*b*, 454*a*, 454*b*, or 454*c*.

In more detail, as shown in FIG. 10, the printed circuit board includes the pins 452*a*, 452*b*, 454*a*, 454*b*, and 454*c* formed by patterning an electrode layer formed on the support substrate 432.

The support substrate 432 may include an insulating layer representing a rigid or flexible characteristic. Preferably, the support substrate 432 may include a resin material including epoxy resin or polyimide resin.

The electrode layer including the pins 452*a*, 452*b*, 454*a*, 454*b*, and 454*c* on the support substrate 432 may include the alloy including Cu, Al, Mo, or W as a conductive material.

Preferably, the electrode layer may be formed by patterning a thin copper film.

A plurality of circuit patterns are formed by patterning the electrode layer. Among them, exposed portions of regions serving as pads like the pins 452*a*, 452*b*, 454*a*, 454*b*, and 454*c* of the terminal region 450*a* are plated as shown in FIG. 10.

The plating protects the exposed portions from external physical and chemical shocks and improves electrical conductivity.

A plating layer 458 may be formed by using nickel (Ni), gold (Au), silver (Ag), or palladium (Pd). Preferably, the plating layer 458 may be formed by plating Ni or Au on the thin copper film.

The concave part 457 may be formed by removing at least the plating layer 458 so that the pins 452*a*, 452*b*, 454*a*, 454*b*, and 454*c* provided under the plating layer 458 are exposed. As described above, the concave parts 457 are formed at the edge regions of the 452*a*, 452*b*, 454*a*, 454*b*, and 454*c*, so that the plating layer 458 is firmly fixed to the electrode layer.

In this case, according to the embodiment, the concave part 457 is formed by removing the electrode layer, so that the lower portion of the support substrate 432 may be exposed. In addition, the concave part 457 may be provided in the form of a vial hole formed by removing the support substrate 432.

The concave parts 457 are formed at the edge region of the pins 452*a*, 452*b*, 454*a*, 454*b*, and 454*c* except for the central region of the pins 452*a*, 452*b*, 454*a*, 454*b*, and 454*c* making contact with the pins of the connector 511 of the lighting module 500, thereby increasing the fixing strength of the plating layer 458 while maintaining the pins 452*a*, 452*b*, 454*a*, 454*b*, and 454*c* in the planarization state, so that the reliability can be improved.

The printed circuit board further includes a solder resist 456 to cover the upper region of the support substrate 432 except for the pad including the pins 452*a*, 452*b*, 454*a*, 454*b*, and 454*c*.

Meanwhile, the terminal region 450*a* may have the structure shown in FIG. 11.

The terminal region 450*a* of FIG. 11 includes an upper pin 152 on the support substrate 432 and a lower pin 153 under the support substrate 432.

When the upper and lower pins 152 and 153 of the support substrate 432 are formed, the lamination structures formed at both sides of the support substrate 432 include the same structure including an electrode layer, plating layers 154 and 156, and the solder resist 157.

In this case, the upper and lower pins 152 and 153 are provided in a zig-zag pattern as shown in FIG. 11.

In other words, the center of the lower pin 153 is provided corresponding to the region between upper pins 152, so that the top surface of the communication module 400 may be distinguished from the bottom surface of the communication module 400.

In addition, pins 501 make contact with the connector 511 of the lighting module 500 at different points, so that the pressure according to the contact may be distributed.

As described above, a plurality of functional elements constituting the communication module 400 may be realized in one printed circuit board. The antenna pattern 415, the pins 452 and 454, and the internal circuit pattern of the module region 430*a* may be simultaneously formed by patterning the electrode layer on the support substrate 432 of the printed circuit substrate.

The printed circuit board constituting one communication module 400 may have various circuit patterns according to the type of the wireless integrated circuit 435 and the lighting control scheme of the lighting part 530.

Therefore, when a plurality of printed circuit boards are formed according to the type of the wireless integrated circuit 435 and the lighting control scheme, the communication module 400 may be constructed by selectively coupling the specific printed circuit board to the housing 411 or 431 of the communication module 400.

Hereinafter, another embodiment will be described with reference to FIGS. 12 to 14.

The basic components of the communication module are the same as those described with reference to FIGS. 7 and 8.

Figure 12:
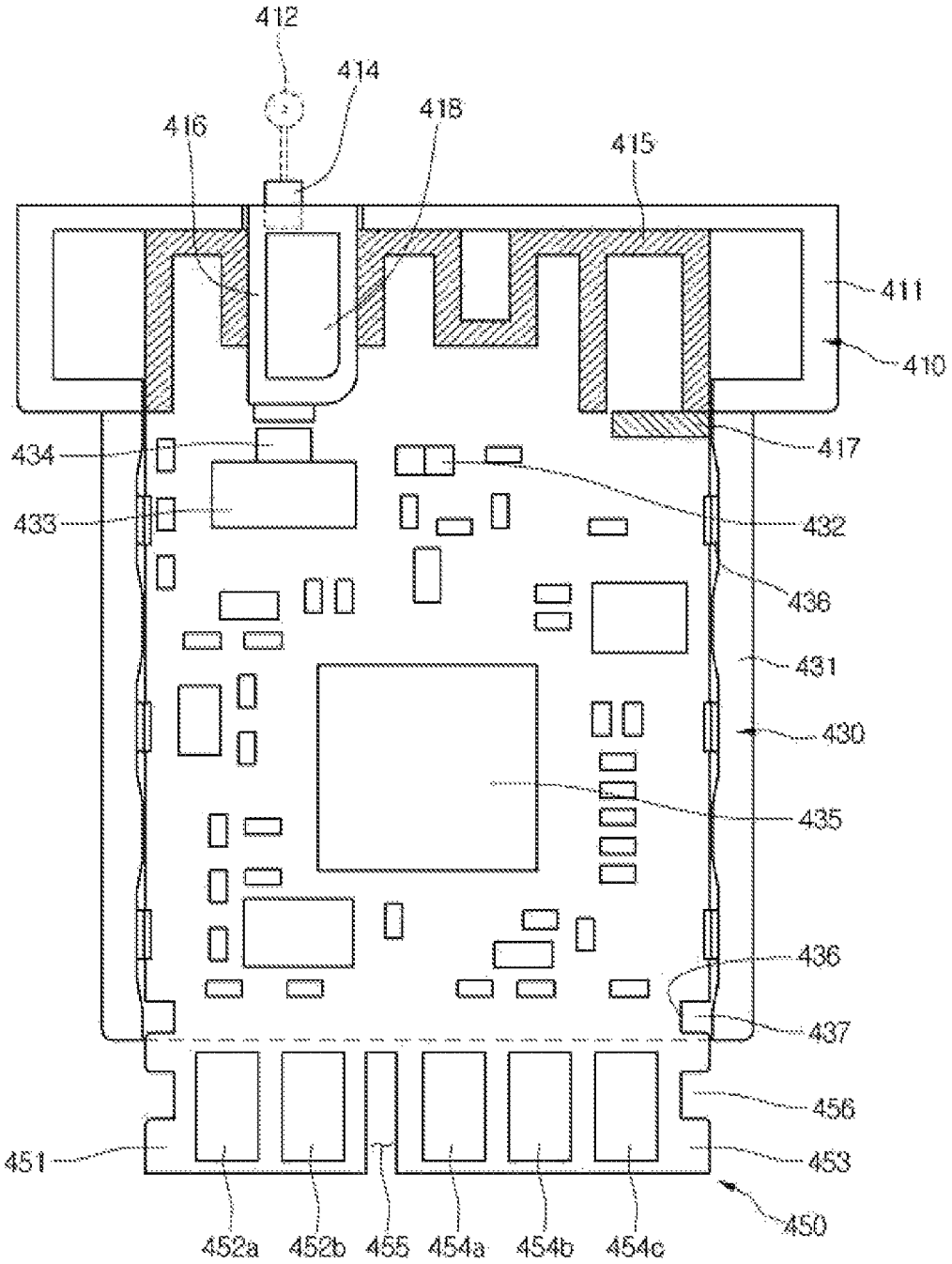
FIG. 12 is a sectional view showing the inner part of the communication module of FIG. 6 according to another embodiment.
Figure 13:
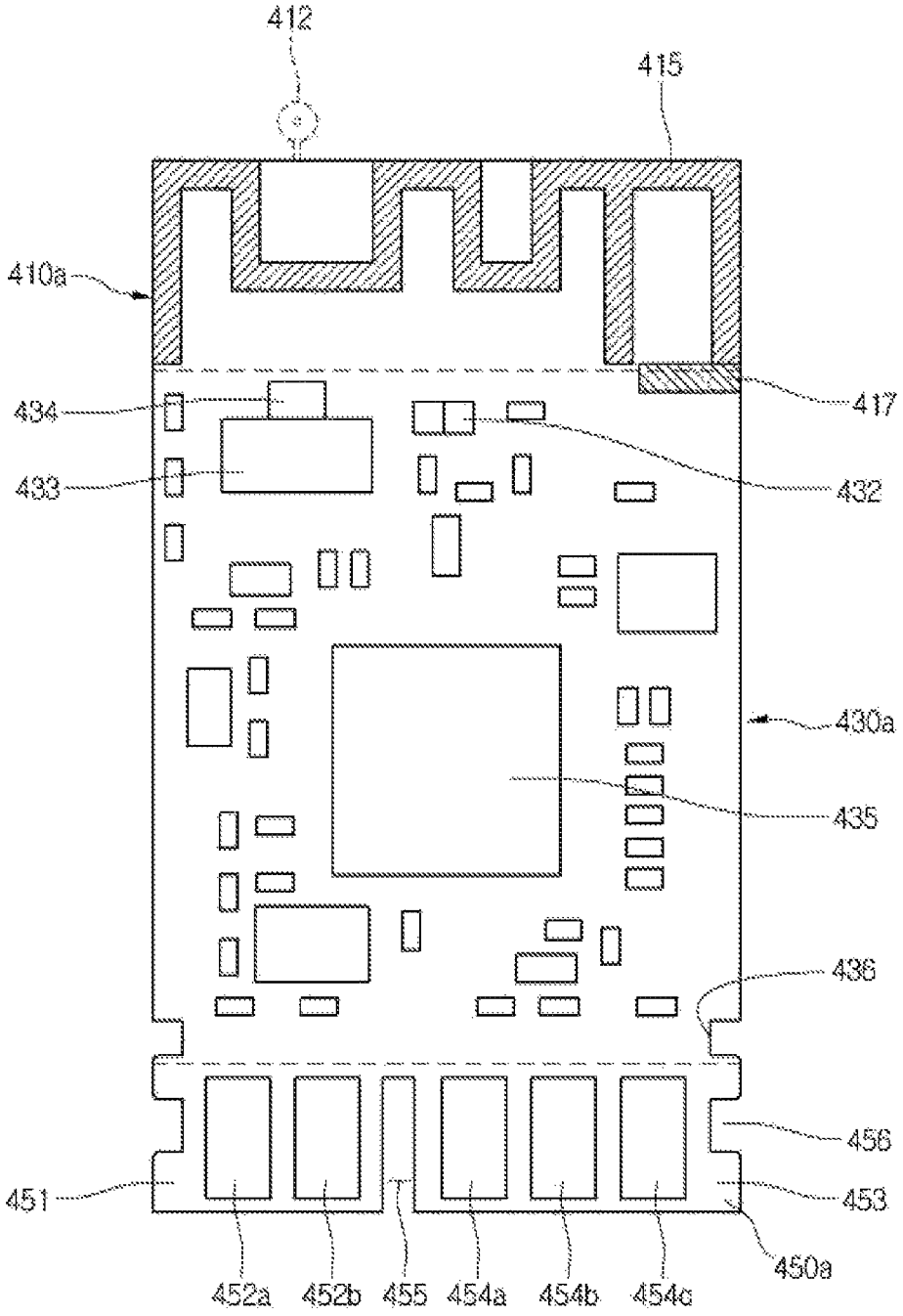
FIG. 13 is a top view showing the printed circuit board of FIG. 12.

Referring to FIGS. 12 and 13, the housings 411 and 431 of the communication module includes the receiving part 411 receiving the antenna 410 and the second receiving part 431 protruding from the first receiving part 411 in the first direction (x axis) and receiving the wireless communication module 430.

As shown in FIG. 7C, the first receiving part 411 includes an opening 412 formed in an opposite surface to a surface viewed in the first direction, that is, a surface from which from which the second receiving part 431 protrudes.

The opening 412 has the shape of a hole passing through the first receiving part 411.

The opening 412 is used to a passage to emit light when external device detects the erroneous operation of the internal device.

The printed circuit board inserted into the space of the first receiving part 411 includes an antenna region corresponding to the antenna part 410.

The antenna region 410*a* is formed at one end of the printed circuit board as shown in FIG. 13, and includes the antenna pattern 415 formed on the support substrate 432 through a patterning process.

The antenna pattern 415 may have the shape of a planar inverted F antenna (PFIA), but the embodiment is not limed thereto.

The module region 430*a* of the printed circuit board corresponding to the wireless communication part 430 inserted into the space of the second receiving part 431 has a plurality of devices mounted therein as shown in FIG. 13.

The module region 430*a* is provided therein with the wireless integrated circuit 435 to make communication with the wireless controller 300. The wireless integrated circuit 435 may selectively employ one of ZigBee, WiFi, Z-wave, and Bluetooth wireless integrated circuits according to the wireless environment. In this case, the passive devices and the circuit configurations of a peripheral part of the wireless integrated circuit 435 may be varied according to the types of the wireless integrated circuit 435.

The module region 430*a* includes a reset switch 433 and a display part 432 provided at the boundary region with the antenna region.

The reset switch 433 resets the operation of the wireless integrated circuit 435, and aligned in line with the opening 412 of the first receiving part 411.

The reset switch 433 includes a terminal 434 interposed between the opening 412 and the reset switch 433, and recognizes the reset command through the contact with the terminal 434 to reset the wireless integrated circuit 435.

Meanwhile, the display part 432 is formed adjacent to the reset switch 433.

The display part 432 includes at least one light emitting diode, and the light emitting diode monitors the operating state of the wireless integrated circuit 435. Accordingly, when an erroneous operation occurs, the light emitting diode is turned on to emit light.

The housing 411 or 431 includes contact parts 416 and 418 protruding from the inner part of the housing 411 or 431 while floating above the antenna region 410*a*.

The contact parts 416 and 418 are interposed between the opening 412 of the first receiving part and the reset switch 433.

The contact parts 416 and 418 may be integrally formed with the first receiving part 411. Alternatively, the contact parts 416 and 418 may be attached to the inner surface of the first receiving part 411.

The contact parts 416 and 418 may include the core part 418 and a protective part 416 surrounding the core part 418.

The protective part 416 may include a material to transfer light, and serve as a light guide between the display part 432 and the opening 412.

The lateral side of the protective part 416 facing the display part 432 may be curved.

The contact parts 416 and 418 may further include a contact terminal protruding toward the terminal 434 of the reset switch 433.

The contact terminal is spaced apart from the terminal 434 of the reset switch by a predetermined distance in the normal operation.

The light emitting device constituting the display part 432 is spaced apart from the contact parts 416 and 418 while forming a predetermined angle with respect to the contact parts 416 and 418, and the light emitted from the display part 432 is discharged to the outside through the opening 412 after being transmitted along the surfaces of the contact parts 416 and 418.

In this case, although the opening 412 may directly pass through the first receiving part 411 as shown in FIG. 6, the opening 412 may be formed in a protrusion 414 protruding from the first receiving part 411.

When the opening 412 is formed in the protrusion 414 of the first receiving part 411 as described above, if the light is emitted through the opening 412, the erroneous operation of the communication integrated circuit 435 may be detected by an external device, and a pressure may be applied to the protrusion 414.

If the pressure is applied to the protrusion 414, the contact parts 416 and 418 are pushed by elasticity to make contact with the terminal 434 of the reset switch 433, so that the reset switch 433 is operated. Accordingly, the communication integrated circuit 435 may be reset.

In this case, when the opening 412 is formed without the protrusion 414, the contact parts 416 and 418 may be directly pressurized by using a structure passing through the opening 412.

Figure 14:
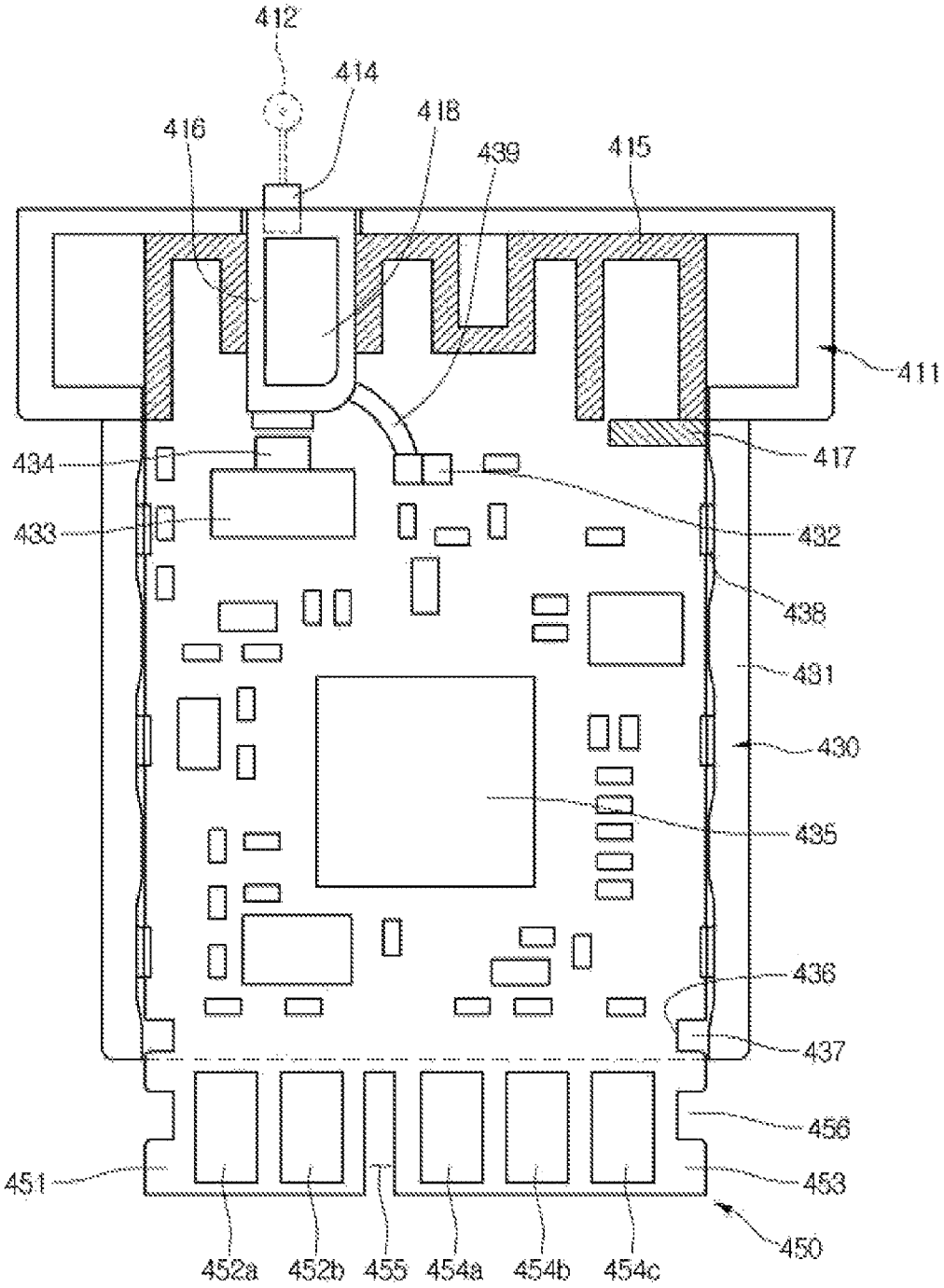
FIG. 14 is a sectional view showing the inner part of the communication module of FIG. 6 according to still another embodiment.

In this case, to reduce light loss in the space between the display part 432 and the contact parts 416 and 418 as shown in FIG. 12, a wave guide 439 may be formed in the space between the display part 432 and the contact parts 416 and 418 as shown in FIG. 14.

The wave guide 439 may transmit the light emitted from the light emitting device of the display part 432 to the contact parts 416 and 418 without light loss through the total reflection.

Meanwhile, a connection pattern 417 may be formed at the boundary between the module region 430*a* and the antenna region 410*a* for the purpose of the connection with an external antenna.

The recess part 436 is formed at the boundary between the module region 430*a* and the terminal region 450*a* in order to fix the housing 411 or 431 to the printed circuit board. The recess part 436 is coupled with a protrusion formed from the inner surface of the housing 411 or 431.

In addition, the housing 411 or 431 includes a plurality of fixing protrusions 438 to fix the lateral side of the printed circuit board in addition to the protrusion 437 coupled with the recess part 436.

The fixing protrusions 438 may have the heights lower than that of the protrusion 437.

The terminal region 450*a* of the printed circuit board corresponding to the interface part 450 protruding from the end portion of the second receiving part 431 includes the pins 452*a*, 452*b*, 454*a*, 454*b*, and 454*c* as shown in FIG. 6.

The terminal region 450*a* may have the length d8 of 3.5 mm to 4.0 mm in the first direction (x axis) from the end portion of the housing 411 or 431, and may have the width d3 of 15 mm in the third direction (y axis).

The terminal region 450*a* includes the pins 452*a*, 452*b*, 454*a*, 454*b*, and 454*c* on the support substrate 432. The terminal region 450*a* may include the five pins 452*a*, 452*b*, 454*a*, 454*b*, and 454*c* as shown in the drawings, but the embodiment is not limited thereto.

As described above, a plurality of functional elements constituting the communication module 400 may be realized in one printed circuit board. The antenna pattern 415, the pins 452 and 454, and the internal circuit pattern of the module region 430*a* may be simultaneously formed by patterning the electrode layer on the support substrate 432 of the printed circuit substrate.

The printed circuit board constituting one communication module 400 may have various circuit patterns according to the type of the wireless integrated circuit 435 and the lighting control scheme of the lighting part 530.

Therefore, when a plurality of printed circuit boards are formed according to the type of the wireless integrated circuit 435 and the lighting control scheme, the communication module 400 may be constructed by selectively coupling the specific printed circuit board to the housing 411 or 431 of the communication module 400.

Hereinafter, the structure of the interface part 450 and the circuit configuration of the module region 430*a* according to the lighting control scheme will be described with reference to FIGS. 15 to 19.

Figure 15:
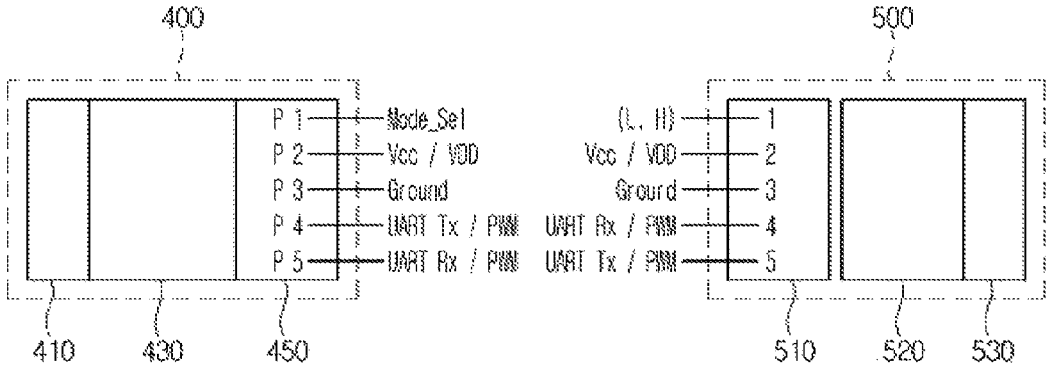
FIG. 15 is a view showing the correspondence between interface parts of the lighting apparatus of FIG. 1.

FIG. 15 is a view showing the correspondence between interface parts of the lighting apparatus of FIG. 1.

Figure 16:
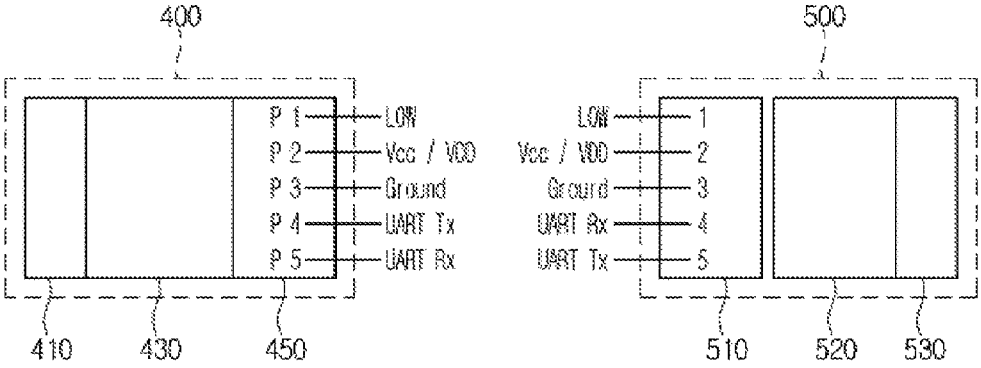
FIG. 16 is a view showing the correspondence shown in FIG. 15 according to one embodiment.

FIG. 16 is a view showing the correspondence shown in FIG. 15 according to one embodiment.

Figure 17:
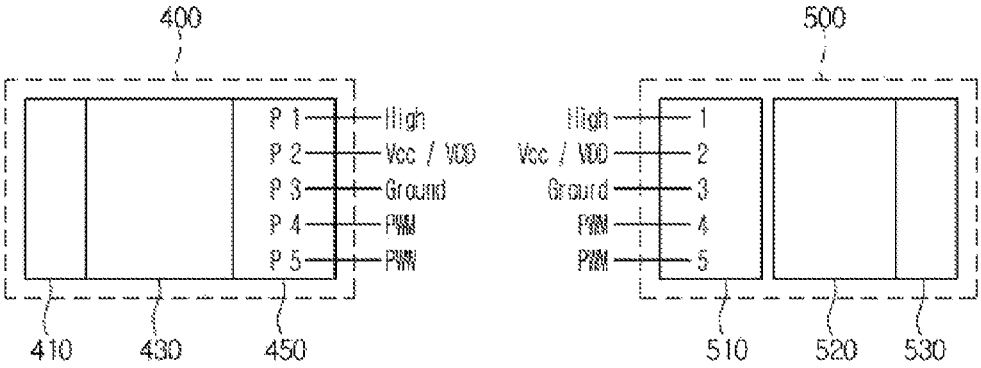
FIG. 17 is a view showing the correspondence shown in FIG. 15 according to another embodiment.

FIG. 17 is a view showing the correspondence shown in FIG. 15 according to another embodiment.

Figure 18:
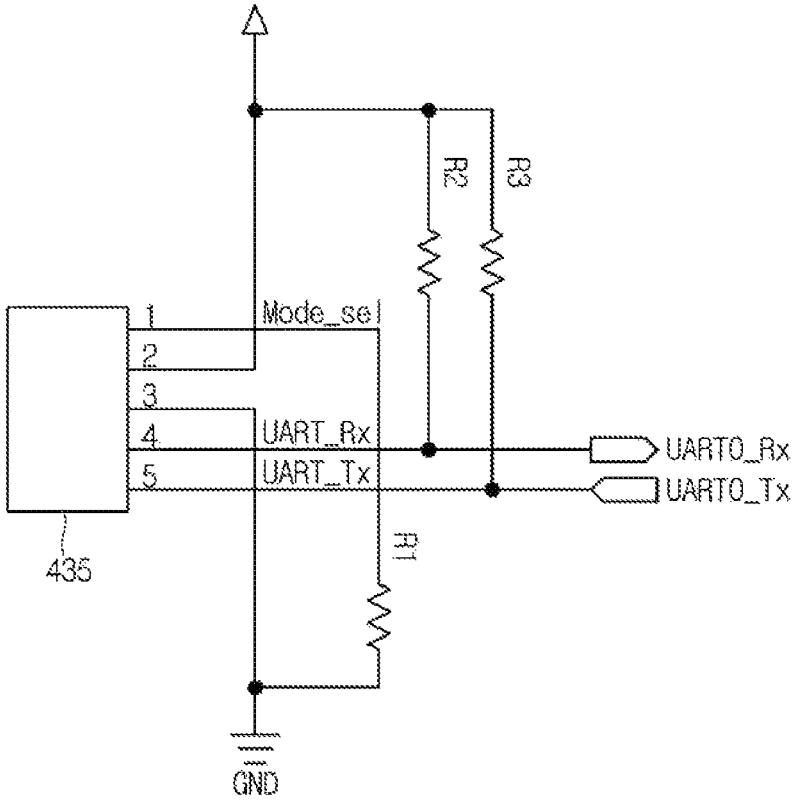
FIG. 18 is a circuit diagram showing the communication module satisfying the correspondence of FIG. 16.

FIG. 18 is a circuit diagram showing the communication module satisfying the correspondence of FIG. 16.

Figure 19:
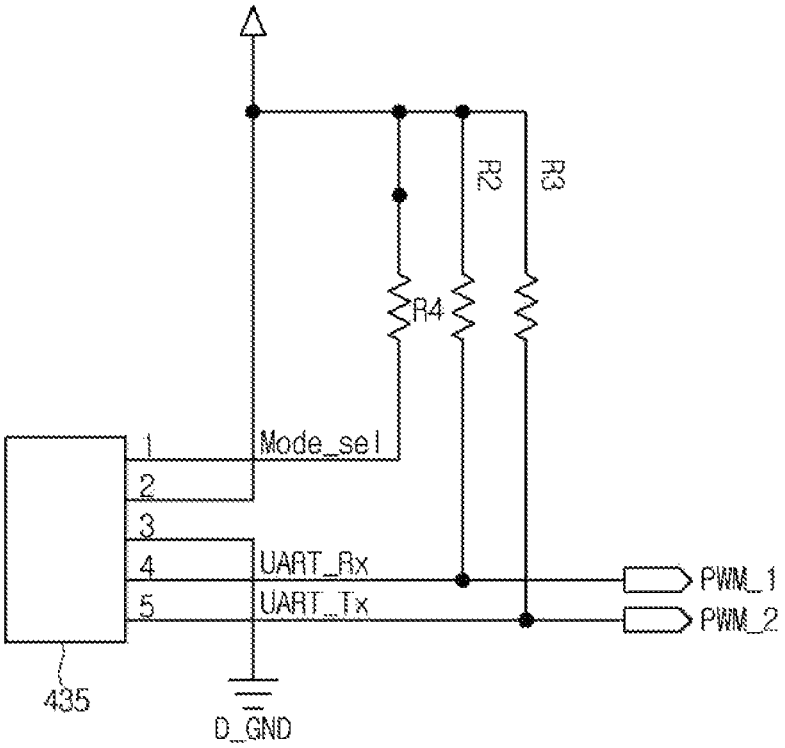
FIG. 19 is a circuit diagram showing the communication module satisfying the correspondence of FIG. 17.

FIG. 19 is a circuit diagram showing the communication module satisfying the correspondence of FIG. 17.

Hereinafter, pins will be assigned with reference signs P1 to P5.

Referring to FIG. 15, when the interface part 450 of the communication module 400 constituting the lighting apparatus 100 includes the five pins P1 to P5, the pins of the interface part 450 of the communication module 400 and the pins of the connector of the interface part 510 constituting the lighting module 500 have output signals set as shown in FIG. 15.

In other words, the first pin P1 outputs a mode control signal Mode_Sel to define mode selection according to the lighting control scheme, the second pin P2 receives reference voltage Vcc/Vdd to drive the communication module 400, and the third pin P3 receives a grounding voltage Ground. The fourth and fifth pins P4 and P5 transmit and receive lighting control signals, respectively. In addition, the fourth and fifth pins P4 and P5 may transmit different lighting control signals.

In other words, the first to third pins P1 to P3 are related to the reference voltage Vcc/Vdd, and the fourth and fifth pins P4 and P5 are related to the control signal. The recess part 455 may be formed between the third and fourth pins P3 and P4.

The lighting control scheme may include a UART scheme or a PWM scheme. The mode control signal Mode_Sel is set to a high state High or a low state Low according to the lighting control scheme.

Hereinafter, the UART scheme will be described with reference to FIGS. 16 and FIG. 18. The UART scheme employs two pins. One pin is used to receive a signal, and the other pin is used to transits a signal.

The UART scheme is employed in order to control flat panel lighting or lighting, which relatively more requires control, particularly, LED lighting (the color temperature, the bright, or the dimming of the LED lighting), but the embodiment is not limited thereto. In other words, the UART scheme may be varied according to settings. In this case, the lighting module 500 generally has an additional control part (MCU). However, the lighting module 500 may be directly controlled without a control part.

As described above, when the lighting module 500 is controlled through the UART scheme, the mode select signal Mode_Sel is set to a low state, the fourth pin P4 is set as a transmission pin, and the fifth pin P5 is set as a reception pin.

To this end, the printed circuit board includes a circuit shown in FIG. 18.

In other words, the circuit shown in FIG. 18 is formed between five terminals of the wireless integrated circuit 435 and five pins P1 to P5 of the terminal region 450*a*. When the reference voltage and the grounding voltage are applied, the fourth and fifth pins P4 and P5 are connected to a terminal of the reference voltage and connected to pull-up resistors R2 and R3, respectively.

In this case, the first pin P1 outputting the mode select signal Mode_Sel is connected to the terminal of the grounding voltage and a pull-up resistor R1, so that the mode select signal Mode_Sel is set to a low value.

Meanwhile, the PWM scheme will be described with reference to FIGS. 17 and 19. The PWM scheme is a control scheme used to simply adjust the brightness of a light emitting diode, but the embodiment is not limited thereto. The lighting module 500 may control the lighting brightness due to the duty ratio of a pulse width.

The control of the lighting brightness may include the control of the color temperature, the brightness, and the dimming.

If the lighting module 500 is controlled through the PWM scheme as described above, the mode select signal Mode_Sel is set to a high state, the fourth pin P4 controls a warm color temperature in dimming, and the fifth pin P5 controls the cool color temperature in the dimming. Accordingly, when the color temperature is controlled, the control signal is simultaneously output to the fourth and fifth pins P4 and P5.

To this end, the printed circuit board includes a circuit shown in FIG. 19.

In other words, the circuit shown in FIG. 18 is formed between five terminals of the wireless integrated circuit 435 and five pins P1 to P5 of the terminal region 450*a*. When the reference voltage and the grounding voltage are applied, the fourth and fifth pins P4 and P5 are connected to a terminal of the reference voltage and connected to pull-up resistors R2 and R3, respectively.

In this case, the first pin P1 outputting the mode select signal Mode_Sel is connected to a pull-up resistor R4, so that the mode select signal Mode_Sel is set to a high value.

Although the lighting is controlled by using five pins P1 to P5 as described above, the lighting may be controlled by using a plurality of pins, but the embodiment is not limited thereto.

In addition, the switching from the UART scheme to the PWM scheme may be determined according to the modte select signal Mode_Sel. In addition, the switching from the UART scheme to the PWM scheme may be realized through a switch on the surface of the communication module.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A lighting apparatus comprising:

a lighting module and a communication module, the communication module comprising:

a housing provided therein with a space; and a module substrate in the space of the housing and having a wireless communication chip mounted thereon, wherein the communication module is detachably coupled with said lighting module and configured to generate an output signal from a control signal received through a wireless network and configured to transmit said output signal to the lighting module, wherein said housing is provided therein with an antenna part, a wireless communication part, and an interface part, and each of the antenna part and the interface part is arranged at opposite sides of said wireless communication part, wherein said housing is configured to be inserted into a body of the lighting module, and wherein the antenna part houses an antenna pattern on a circuit board, and when the housing is inserted into the body of the lighting module, the antenna part of the housing corresponding to the antenna pattern is exposed outside the body of the lighting module, wherein the housing is provided at a lateral side thereof with an opening, wherein the module substrate is provided with a reset switch to reset the wireless communication chip and a display part to display a state of the wireless communication chip through the opening, wherein the reset switch is disposed on the module substrate to align in line with the opening of the housing, and the display part is disposed adjacent to the reset switch, and wherein the display part is spaced apart from the opening while forming a predetermined angle with respect to the opening, wherein the interface part includes a plurality of pins connected with an interface of the lighting module to transmit the output signal generated from the wireless communication part, and wherein the pins includes a mode select pin to select a control scheme of the lighting module among the control scheme including to a UART scheme and a PWM scheme, and the mode select pin outputs a high signal or a low signal according to the control scheme of the lighting module.

2. The lighting apparatus of claim 1, wherein the module substrate comprises:

the antenna part;

the wireless communication part to receive the control signal from the antenna part and to generate the output signal to be transmitted to the lighting module from the wireless communication chip; and the interface part.

3. The lighting apparatus of claim 2, wherein the housing includes:

a first receiving part to receive the antenna part; and a second receiving part to receive the wireless communication part, and wherein the interface part protrudes out of the housing.

4. The lighting apparatus of claim 3, wherein the pins are divided into at least two pin groups, and a recess part is formed between the pin groups such that the pin groups are spaced apart from each other, and wherein the pin groups include different numbers of pins.

5. The lighting apparatus of claim 4, wherein the pins are formed on top and bottom surfaces of the module substrate, and the pins on the top surface and the pins on the bottom surface are arranged in a zig-zag pattern.

6. The lighting apparatus of claim 3, wherein the interface part includes at least one concave part formed at an edge region of a lateral side of the module substrate such that the at least one concave part is fixed to the lighting module.

7. The lighting apparatus of claim 3, wherein each pin is provided on a surface thereof with at least one pin fixing part such that each pin is fixed to the module substrate.

8. The lighting apparatus of claim 2, wherein the antenna part includes an antenna pattern formed on the module substrate through a pattern process, and wherein the antenna part includes a planar inverted F antenna.

9. The lighting apparatus of claim 3, wherein the second receiving part of the housing protrudes from a lateral side of the first receiving part such that the second receiving part is integrally formed with the first receiving part.

10. The lighting apparatus of claim 9, further comprising at least one fixing protrusion protruding from the lateral side of the first receiving part of the housing to fix the lighting module to the communication module.

11. The lighting apparatus of claim 3, wherein the wireless communication chip employs at least one of a ZigBee communication scheme, a Z-wave communication scheme, a WiFi communication scheme, and a Bluetooth communication scheme.

12. The lighting apparatus of claim 1, wherein the module substrate includes locking grooves recessed in the concave shape from both lateral sides, and wherein the locking groove are formed by removing portions of the pins.

13. The lighting apparatus of claim 12, wherein the display part includes at least one light emitting diode, and the at least one light emitting diode emits light when the wireless communication chip erroneously operates.

14. The lighting apparatus of claim 13, further comprising a contact part interposed between the opening and the reset switch and moved by an external pressure to operate the reset device.

15. The lighting apparatus of claim 14, wherein the antenna part is arranged externally with respect to the lighting module.

16. The lighting apparatus of claim 15, wherein the contact part includes a light transmitting material to transmit a light from the display part to the opening.

17. The lighting apparatus of claim 16, further an optical waveguide interposed between the contact part and the display part.

* * * * *